United States Patent [19]

Sengewald

[11] 4,015,771

[45] Apr. 5, 1977

[54] PACKAGING BAG OF THERMOPLASTIC SYNTHETIC PLASTIC FILM

[76] Inventor: Karl Heinz Sengewald, Kuensebeck, Germany, 4801

[22] Filed: Dec. 29, 1975

[21] Appl. No.: 644,594

[30] Foreign Application Priority Data

Jan. 14, 1975 Germany ..... 7500834[U]
Mar. 21, 1975 Germany ..... 2512452

[52] U.S. Cl. ..... 229/62; 229/66; 229/85

[51] Int. Cl.[2] ..... B65D 33/20; B65D 33/36

[58] Field of Search ..... 229/62, 66, 85; 150/7; 206/801

[56] References Cited

UNITED STATES PATENTS

| | | | |
|---|---|---|---|
| 2,363,957 | 11/1944 | Goff | 229/85 |
| 2,668,769 | 2/1954 | Schlienz | 229/85 |
| 3,015,918 | 1/1962 | Schoen | 229/62 X |
| 3,089,635 | 5/1963 | Kugler | 229/62 |
| 3,310,225 | 3/1967 | Hoblit et al. | 229/66 X |
| 3,385,428 | 5/1968 | Kugler | 206/801 |
| 3,419,136 | 12/1968 | Pratt | 229/66 X |
| 3,510,052 | 5/1970 | Ruda | 229/66 X |

*Primary Examiner*—Stephen P. Garbe
*Attorney, Agent, or Firm*—P. D. Golrick

[57] ABSTRACT

A side-seamed two-panel thermoplastic film bag suited for packaging printed matter, having an open mouth to be transversely seam-sealed closed after initial filling with one panel end projecting beyond the mouth as a suspension portion with wicket-accepting hanging holes, and an extension of the second panel at the other end reflected onto the first panel as a bag closure flap with lateral ends secured to the other panel by the side seam-welds, the flap having oblique tear perforation lines up from the bottom corners, a permanently tacky adhesive stripe between the perforation lines releasably bonding the flap to first panel, whereby the closure is easily hand-torn and opened for content inspection and re-closure by the adhesive.

5 Claims, 8 Drawing Figures

PACKAGING BAG OF THERMOPLASTIC SYNTHETIC PLASTIC FILM

The present invention is particularly concerned with a thermoplastic synthetic plastic film bag to serve as shipping packaging for printed material or the like, in a bag form open at one end to be closed by a seam weld after filling and also with a method for fabricating the same.

Bags which serve as enclosures for printed materials are usually comprised of polyethylene suited for shipping or distribution packaging.

Preferably the bags are delivered in the so-called wicket method, that is, a number of the bags stacked into a pad or block form are brought onto the stack rods or wickets, or other support means, either for simple process transport purposes in manufacture, or as a simple immediate supply storage support means at a place of use such as a filling machine or station. Respective wickets or stack supporting rods disposed in appropriately spaced pairs usually form part of a bag pad conveyor, for example, in chain conveyors which either carry the completed bag pads or blocks away one after another, or supply them to a filling or loading machine.

Depending upon the design, structure or capability of the filling machine, the bags delivered in this fashion are filled by hand, semi-automatically, or fully automatically, and then each sealed at the mouth, for example, by a severing welding operation, which also separates and blows away the excess material represented in the so-called wicket flap by which the block is applied on the stack rods of the conveyor.

Polyethylene bags particularly of the usual sort, which serve as shipping packaging for printed material are very hard to open, because the film material by hand can only be torn with considerable difficulty, though indeed it tears further once it has been initially torn or is cut with shears.

The object of the invention is to provide a synthetic plastic bag, particularly a shipping package for printed material or the like, which is easily opened for inspection of its contents, and likewise can easily be reclosed, for further use; and at the same time bag is simple to manufacture continuously and fully automatically.

To this end, by the invention for a bag of the type described, an end extension of one wall-forming panel is folded over onto the other panel as a closure flap, and there secured by a permanently tacky cement or adhesive, and the flap lateral ends are included in side seam welds securing the panels together in the bag. With this structure, by freeing the adhesive, the packaging can be opened for inspection of the contents, for example, and thereafter be re-closed for further use.

For one advantageous embodiment or application of the invention, in both ends of the closure flap, at the regions of the bag sides, where the flap lateral ends are comprehended in the bag side seam welds, there are perforation lines extending over the flap height, which can be torn in opening of the closure, and the flap can be completely unfolded straight for removal of the bag contents, so that access to the bag contents is substantially facilitated.

To make tearing at the perforations easier, these start at the bag bottom corners and run obliquely upwardly and inwardly, so that outside of each perforation line there is a flap edge region where the flap can be grasped between thumb and index finger for tearing the perforation lines.

After inspection of the contents, the closure flap is simply folded back again onto the adjacent bag wall and re-secured by the permanently tacky adhesive.

By another aspect of the invention one of the bag wall forming panels is extended upwardly to form a lip or further projecting margin, which facilitates filling of the bags. Also this affords a suspension area whereby the bags stacked in a block may be impaled on needles, or with punched holes, suspended on a wicket or stacking rods for supply to a filling machine.

For fabrication of the bag type package of the invention it is especially advantageous that two webs of thermoplastic synthetic plastic film of equal or essentially equal widths be brought together in superimposed relation in what may be termed a composite web, with however a lateral displacement relative to one another, so that a longitudinal margin of each web projects beyond the respective edges of the other, respectively forming stock for the closure flap and for the mouth or hanger end projection.

Then in the web margin providing the closure flaps, at longitudinal spacings corresponding to bag widths, pairs of perforation lines in V-shaped disposition are successively punched, reaching into the adjacent edge of the other web, there nearly to intersect as the Vee apex. Also in the other projecting margin, paired stack hanger holes are punched. Further along the web margin adjacent the flap stack margin, a non-setting adhesive cement is continuously applied preferably with interruptions opposite the V-shaped perforations. Then the closure flap stock margin is continuously folded up over the adjacent edge of the other web. Finally at the lead web end, the composite web is severed transversely between each pair of perforation lines, separating individual finished bags by a transverse severing weld in combination with a transverse weld seaming.

For this method, especially advantageously, the starting material is two superimposed film webs of equal breadth, which are continuously longitudinally centrally slit, thereby forming two smaller superimposed web pairs. The two halves of one web are displaced laterally from one another and relative to the halves of the other film web respectively outwardly by an amount equal to the width of the closure flap or of the hanger strip portion.

Other objects and advantages will appear from the following description and the drawings wherein.

Figure 4:
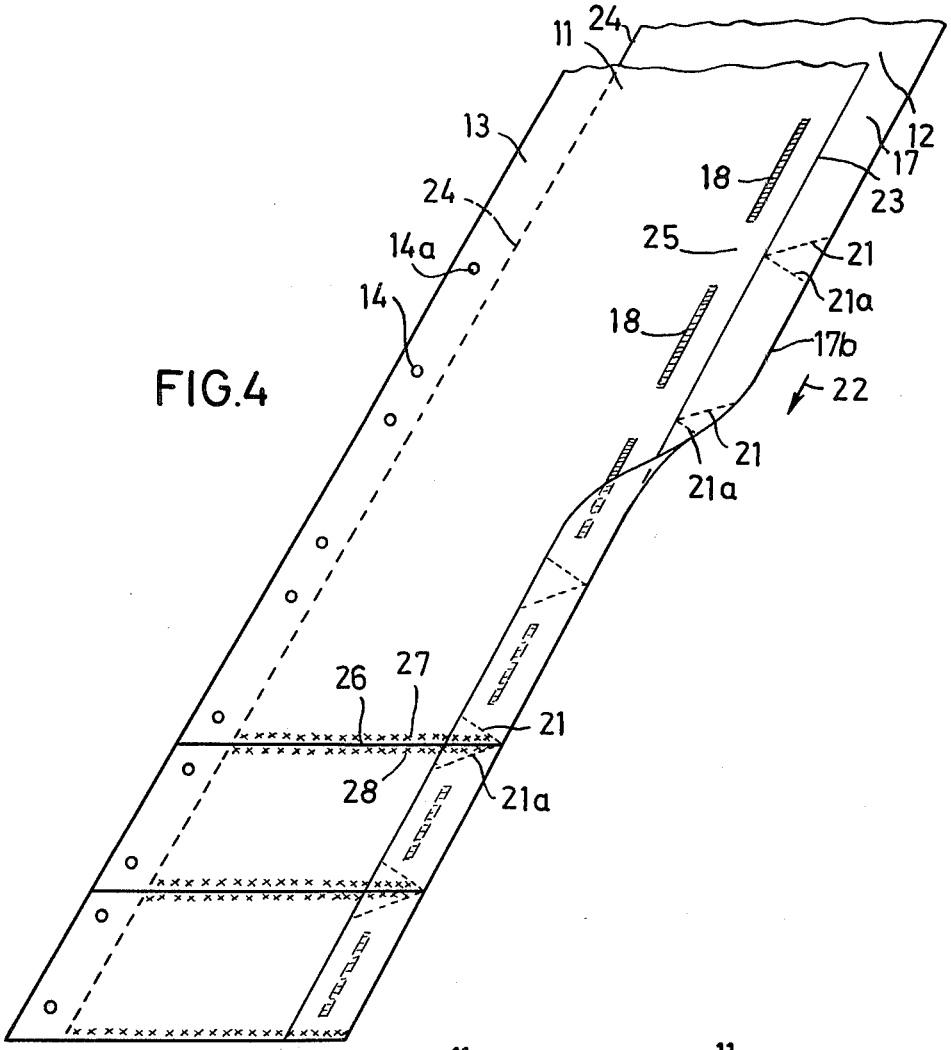
Figure 5:
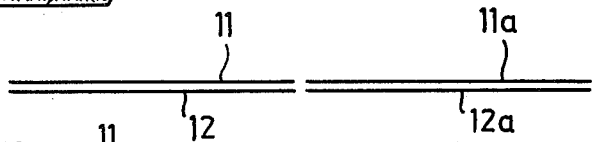
Figure 5A:
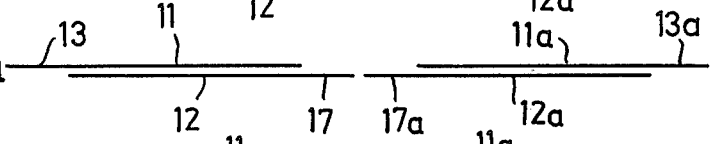
Figure 6:
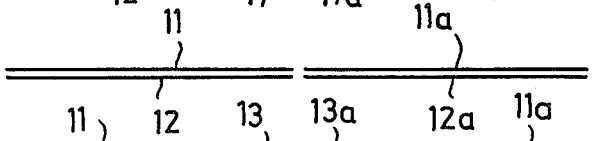

FIG. 4, in a perspective schematic view, presents the principal and characterizing steps of the method of bag fabrication;

FIG. 5 is a section showing (schematically) the manner of the feed and longitudinal cutting of two film webs;

FIG. 5*a* shows the relative lateral displacement of the film webs of FIG. 5;

FIGS. 6 and 6 *a* corresponding to FIG. 5 and FIG. 5a show a further modification of method.

PRODUCT BAG

Figure 1:
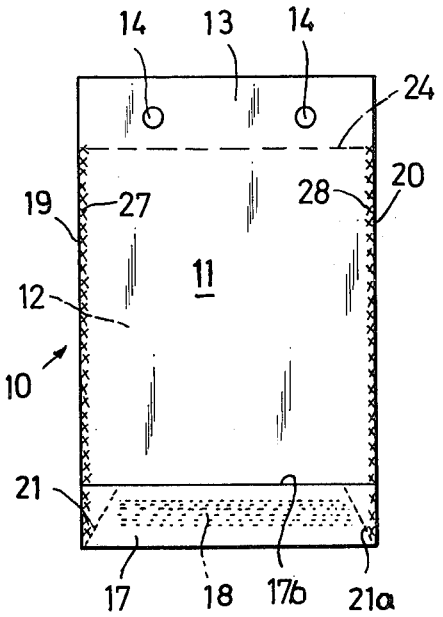
FIG. 1 is a front face elevation of a shipping or packaging bag provided at its bottom end with a reusable closure flap, as it appears before filling.
Figure 2:
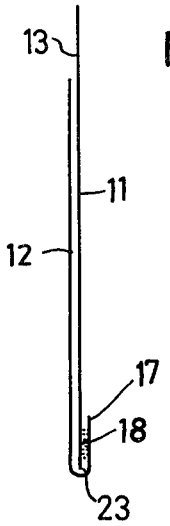
FIG. 2 is a schematic vertical longitudinal section of the packaging bag of FIG. 1.

The bag 10 represented in FIGS. 1–2, particularly adapted for packaging to ship printed material or the like, is comprised of two film panels 11, 12, of thermoplastic synthetic plastic such as sturdy heavy gauge polyethylene film forming the bag walls. For convenience of reference, the end of the bag bearing the closure flap is here considered and termed the bottom end, while the panels 11 and 12 may be termed the front and back walls. The bag is open at the top end providing a filling mouth to be thermoplastically seam welded closed after loading.

At the top and bottom of the bag, integral panels extensions provide, first, a hanger portion or wicket flap 13 which may be impaled on a series of needles or as here shown is provided with a pair of symmetrically spaced hanger apertures 14, to serve for bag suspension or other purposes as hereinafter described; and secondly, a closure flap 17 releasably bonded closed, but openable for access to the contents and thereafter reclosable.

In the specific bag form, at the top end, the front panel 11 extends beyond the top edge of the underlying back panel 12 to provide the hanger 13; and at the bottom end, the rear panel or wall 12 similarly is extended in a flap 17, folded across the bottom edge 23 of the top panel and there secured by a non-hardening, that is, permanently tacky adhesive applied therebetween, for example, as the stripe 18 on and spaced slightly from the bottom edge 23 of panel 11. Here the stripe 18 terminates short of the location of the two perforation lines **21, 21*a*, running obliquely in the closure flap 17 from the bottom bag corners, that is, beginning at the fold, running upwardly and convergently inwardly to the free edge of the flap; and also is spaced in somewhat from flap edge 17*b***.

At lateral margins or edges 19 and 20 the panels are joined by welded side seams 27, 28 with the lateral ends of the flap 17 also included in the welded seam joining.

It should be noted that a bag of the general structure and character here described may also advantageously be used without the single layer hanger extension 13. Irrespective of whether or not such a hanger extension is used for convenience in handling of bags stacked in a block, the bag form is useful per se since, after bag filling, a seam weld still can be made across the mouth. Also thicknesses or extensions of both panels may be used to provide an area in which either suspension holes 14 are made or which may be used for impaling on stack needles. However, the bag form here shown, by terminating the back wall short of the hanger portion, in some degree saves material; and further is particularly adapated for one aspect of the method later described.

The single extension 13 apart from its utility as a wicket flap or hanger portion in another way may facilitate bag loading or filling, to the extent that it can help to funnel in or guide material being loaded by and or otherwise.

Figure 3:
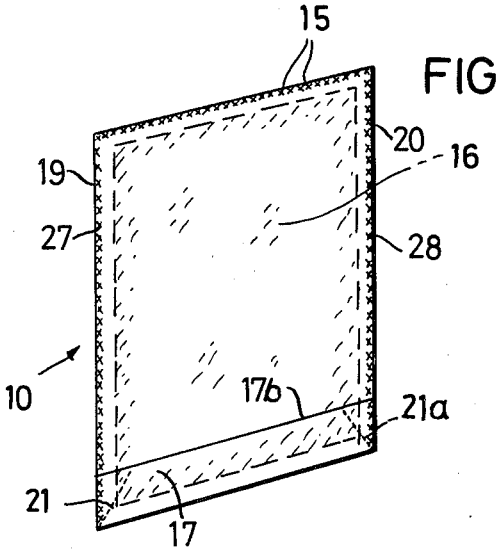
FIG. 3 is a perspective view of a bag such as that in FIG. 1 after filling and sealing with excess material trimmed.

Bags of the form shown in FIGS. 1–2 are usually stacked into a pad or block and so delivered from the fabricating machine, and also further transported by the so-called wicket method, wherein, as a block, they are hung by the hanger holes 14 on respective pairs of spaced stacking rods of conveyors, especially chain conveyors, which conduct and supply the bags to a filling machine or filling station. There the bags individually are semi-automatically filled and at their upper ends sealed closed; the excess film material represented by the suspension portion 13 being then removed. Thus, for example, FIG. 3 shows the bag of FIGS. 1–2 closed by a welding seam at 15 after loading with the bag contents 16. When the seam 15 is made, the so-called wicket flap or projecting strip portion 13 also is severed from the finished package and blown away.

For removal and inspection of the contents 16, the closure flap 17 is gripped manually at a free part of its edge **17*b* and torn at the perforation lines 21, 21*a***, with parting at the adhesive bond, and folded downwardly flat to open the bag bottom completely.

With the adhesive stripe 18 terminating just short of the perforations **21, 21*a*, and with the outer ends of the closure flap 17 also being bonded to the underlying panel edges by the side seam welds, grasping and tearing off the closure at these lines is facilitated. It should also be noted that the adhesive band as such usefully terminates short of the upper transverse margin 17*b*** of the flap again leaving a free area or edge more easily grasped for tearing in the flap opening operation.

Subsequently the bag can be used again, being reclosed by merely folding the closure flap back onto the adhesive coated area 18; where it is again adherent when the adhesive 13 is chosen of a material appropriate for this purpose. Thus in effect the bag can be reused repeatedly over a rather long period of time.

FABRICATION METHOD

In the following description of an advantageous method for fabricating the above described bag, like reference numerals will be used to designate parts or features of the material in process which correspond to or will become corresponding parts or elements in the product bag above described. Thus webs or web parts which will provide or become in the finished bags the panels or walls 11, 12, or the stock portion for the suspension of hanger portion 13 or the closure flap 17 are designated by like reference numerals.

In FIG. 4, the continuous film webs 11 and 12 of like width (supplied from a source and by means not shown) are advanced in the direction 22 longitudinally in superimposed but laterally offset contacting face-to-face relation in effect as a composite web 11-12, either continuously or step-wise as appropriate for the machine or tooling used.

The centerlines are offset parallel by a distance corresponding to the height of the flap 17, hence here also the height of the suspension portion 13. The top web 11 at the left side thus overhangs or projects beyond the corresponding longitudinal edge 24 of the lower web 12, in a longitudinal web margin 13 which is to become or provides the stock for the hanger strip portion 13 of the product bags. At the other side, the lower web portion projects beyond the respective right margin 23 of the upper web in the longitudinal marginal portion 17 to provide the stock for the closure flap 17 of the product.

As the composite web 11-12 advances, the paired perforation lines 21, 21a, of angular or V-shaped disposition, are successively applied along the projecting margin 17; preferably both lines of each equilateral V-forming pair being simultaneously punched, with a blunt apex of the formation substantially coincident with the edge 23 of the upper web. The spacings as measured between the apices correspond to the desired width of the bags to be produced; the Vee-shape is symmetrical about a transverse line through the apex; and the perforations run in from the edge of 12 each to the edge 23, but with a slight spacing between the line inner ends at this region blunting the apex, as a non-perforated gap space, through which later there will be carried out a transverse seaming simultaneously with a severing cut.

Also on the upper surface of the top web 11, along a longitudinal line parallel to and in a slight spacing inwardly from edge 23, a non-setting, i.e., permanently tacky adhesive is applied preferably in equal stripes 18, with equal gaps 25 centered in relation to respective line perforation pairs 21, 21*a*. This gap or interruption of application is advantageously used because the described transverse severance and seam welding will occur in this region, and also for a structural advantage in later leaving the flap portions delineated by the Vee's and ultimate side seams unbonded to underlying panel areas.

The adhesive can be applied through a conventional adhesive transfer disc rotating in contact with the upper web 11, but having its circumference relieved by a recess, where accordingly no contact is made with the top web; so that at corresponding location and spacing the aforementioned gaps in the adhesive are obtained, by interruption of the otherwise continuous adhesive application. The adhesive can also be applied on the exposed upper side of the projecting margin 17 of the lower web 12, though it is usually more convenient and advantageous to apply it in bands as at 18 on the top side of the web 11.

After completion of these operations, among which it may be noted that the application of the adhesive 18, production of the V-shaped formations 21, 21a, and production of apertures, 14, 14 may take place in different order than in the aforegoing description, the projecting margin 17 is turned through 180° up over the edge 23 and folded back to be applied onto the edge of web 11. Accordingly the reflected margin 17, by means of the adhesive 18, adheres to the web 11. In the marginal region 13 on the other side, the holes 14 and 14*a* are punched at appropriate spacings of the paired hole pattern and, indeed advantageously, at the same time and even at the same work station producing the perforation lines 21 and 21*a* at a corresponding longitudinal region.

Finally at the leading end of the composite web, now having the form of what may be called a "half tube", since the left margin yet remains unsealed or open, by appropriate welding and severance tooling, individual bags are successively cut off from the composite web at a severing cut line location 26 on either side of which the adjacent transverse side seam weldings 27 and 28 are produced.

a severing welding operation may be used wherein simultaneously by a heat severing action there is produced with the severing cut and on either side thereof a fusion of the material of the two webs to each other into a respective bag edge seams. However it is also possible to use a severing cut and simultaneously therewith to carry out distinct excellent welding for the seams at both sides of the cut.

This transverse separation with the transverse welding is of course carried out in the region between the lines in each perforation line pair 21 and 21*a*.

The source of the two webs 11 and 12 used in FIG. 4 may be separate supply rolls at single thickness flat strip, from which separate webs are fed together into the superimposed relation, being guided into the offset relationship shown. The source also may be a supply roll of so-called flat tubular film stock which, as it is longitudinally advanced, is slit along the margins into the separate superimposed webs then guided into the offset superimposed relation shown. Thus the left half or side of the FIGS. 5 and 5*a* could be considered as sections representative of such single webs of appropriate desired width brought into superimposed relation (FIG. 5) and then (FIG. 5*a*) into the offset relation appearing in FIG. 4, it being understood that, in these FIGS. 5–6*a* inclusive, the webs are shown with spaced faces merely for clarity of representation.

FIG. 5 also is representative of a variation in which two wide width superimposed webs, whether derived from respective rolls of single layer stock, or from a roll of flattened tubular film by edge slitting, are then continuously longitudinally centrally slit, resulting in two pairs of superimposed half webs, namely 11, 12 and 11*a*, 12*a*, the upper and lower halves of which are immediately derived from what are respective single larger webs. As the two pairs of half webs are advanced, with the lower half webs 12, 12*a* maintaining their relative positions, the two upper half webs 11, 11*a* may be further separated from each other, and thus similarly displaced relative to the lower half web 12, 12*a*.

The further specific bag making operations can be carried out in the manner shown and described in detail relative to FIG. 4, with the edge or marginal regions 17 and 17*a* reflected respectively by 180° upwardly and into place for the formation of the respective closure flaps.

Figure 6A:
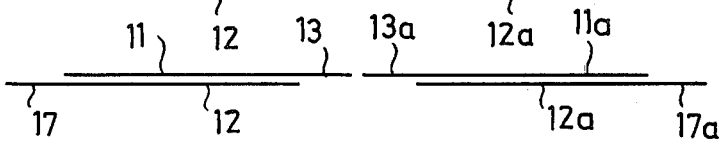

Schematic sectional FIGS. 6–6*a* show a further minor variation in which with the upper half webs 11, 11*a* are maintained in relative position, with the lower half webs 12, 12*a* being spread from each other, and likewise similarly offset laterally relative to the respective top half web.

In any event whether a single composite web is in process, or a pair of parallel running composite webs as described for FIGS. 5–6*a* inclusive, essentially the steps of FIG. 4 are carried out on each composite web.

The previously described FIGS. 5–6*a* show that the bag and its production, in accordance with the invention, are very well suited to fabrication in a machine working either a single composite web or two or more composite webs adjacently to one another, so that simultaneously two or more bags at a time are produced.

In FIG. 6, then the margin or edge regions 17 and 17*a* are upwardly reflected 180° over and into place respectively for producing the closure flaps. In this case accordingly, the adhesive material 18 is applied externally to respective margins 17, 17*a*, for a horizontal web where the adhesive tooling is to work from above.

The stacking of the bags on the wicket prongs, through the margins 13, 13*a* occurs at the middle region between the composite web locatons, where two chain conveyors are disposed adjacently to one another bearing respective stacking elements or wickets. The wicket conveyors for FIGS. 5 5*a* ordinarily would be laterally located.

It is to be understood that in FIGS. 5–6*a* the marginal regions 13, 13*a* also can serve to produce closure elements with the marginal regions 17, 17*a* then serving as hanger hole strips for bag stacking.

Further it should be noted that also the heights of the closure flap and of the hanger or wicket flap can be different. This is determined of course by the desired respective formations of or the closure elements of the bags to be made, and by the capability of the bag making machine. It is to be further understood that in place of the adhesive application in single stripes 18, also a two-sided, i.e., double stripe, bonding can be used with an adhesive of a permanent tackiness at least on the outer one of the cooperating opposed stripe pair.

It is further to be understood that it is not necessary to provide the holes 14 in the hanger portion, if pointed stacking rods or needles are to be used. Also for the utility of the reuseable closure flap 17, which is connected with the bag body through the seam weldings 27, 28 and has perforation lines 21, 21*a* at its ends, it is not absolutely necessary to use the hanger flaps 13, which can be entirely omitted for some purposes.

What is claimed is:

1. A bag of thermoplastic synthetic plastic film, particularly adapted for packaging printed material or the like, comprising:

first and second equi-width panels of thermoplastic synthetic plastic film superimposed, with respective lateral margins aligned, to form opposite bag walls;

the second bag wall panel being continued at one end into an integrally connected short length reflected over the edge of and onto the corresponding end margin of the first panel as a closure flap;

said closure flap being releasably bonded to the said end margin by a stripe of non-hardening adhesive whereby the flap may be lifted to open the bag and then reclosed to be again held by the adhesive;

the lateral margins of said panels being connected by welded side seams, the lateral ends of the closure flap being including in the welded side seams and thereby secured to the bag wall panels;

the ends of the panels distal from the flap being free to afford an open mouth for bag filling, which is thereafter thermoplastically sealable; and in the regions of its two lateral ends the said closure flap having respective lines of perforations each extending over the entire height of the closure flap.

2. A bag as described in claim 1, wherein the stripe of adhesive is located entirely within a closure flap portion bounded by said lines of perforations, to leave respective flap portions, between perforation lines and adjacent side seams, unbonded for grasping to initiate tearing at the respective perforation lines.

3. A bag as described in claim 1, wherein each said line of perforations runs obliquely and inwardly from the adjacent bag corner on up to the free edge of the flap.

4. A bag as described in claim 1, wherein at the mouth end of the bag, one of the bag wall panels projects in a hanger portion extending beyond the other panel.

5. A bag as described in claim 4, wherein the hanger portion is provided with apertures as hanging holes.

* * * * *